United States Patent [19]

Hay et al.

[11] Patent Number: 5,016,878

[45] Date of Patent: May 21, 1991

[54] GAME HAVING MAGNETICALLY OPERABLE PIECES

[75] Inventors: Eric Hay, Johanneshov; Anders Nordström, Kungsägen, both of Sweden

[73] Assignee: NH Produkter Handelsbolag, Kungsangen, Sweden

[21] Appl. No.: 341,965

[22] Filed: Apr. 24, 1989

Related U.S. Application Data

[62] Division of Ser. No. 170,373, Mar. 18, 1988, Pat. No. 4,834,371.

[30] Foreign Application Priority Data

Mar. 25, 1987 [SE] Sweden ..... 8701251

[51] Int. Cl.[5] ..... A63F 7/06

[52] U.S. Cl. ..... 273/85 F; 273/126 A; 273/118 A

[58] Field of Search ..... 273/85 R, 85 A, 85 B, 273/85 E, 85 F, 86 R, 86 B, 86 C, 86 D, 129 L, 129 R, 129 Q, 126 A, 120 A, 1 M, 118 A, 129 W

[56] References Cited

U.S. PATENT DOCUMENTS 2,884,253 4/1959 Rivero-Ferro ..... 273/85 E

FOREIGN PATENT DOCUMENTS 515713 12/1952 Belgium ..... 273/85 F
517446 2/1953 Belgium ..... 273/85 R
2642290 3/1978 Fed. Rep. of Germany .... 273/85 F
1097437 7/1955 France ..... 273/85 F
1133592 3/1957 France ..... 273/85 F
66755 9/1957 France ..... 273/85 F
1144513 10/1957 France ..... 273/85 F
2356440 6/1976 France ..... 273/85 F
552239 11/1956 Italy ..... 273/85 F
677745 7/1939 Netherlands ..... 273/85 E
667539 3/1952 United Kingdom ..... 273/85 F
708238 4/1954 United Kingdom ..... 273/85 F

*Primary Examiner*—Edward M. Coven
*Assistant Examiner*—Sebastiano Passaniti
*Attorney, Agent, or Firm*—Young & Thompson

[57] ABSTRACT

In a game having magnetically operable pieces (3) there are below a game board (2) several operating devices (4) for operating the pieces, these operating devices being separated by intermediate layers (7) that are parallel to the game board. The intermediate layers are thin and easily flexible and rest on top of each other, the game board resting on top of the top intermediate layer. A specially designed piece is included in the game, intended for contact with the game board. This piece has two supports (9, 10) e.g. the feet of a human figure. One (9) of the supports rests on and carries a magnet (8) that can be moved by a cooperating magnet (13) beneath the game board. The other support (10) has a supporting surface (11) of friction material.

5 Claims, 4 Drawing Sheets

GAME HAVING MAGNETICALLY OPERABLE PIECES

The present invention relates to a game having at least two pieces movable on a game board, said pieces each having a magnet and each being magnetically operable by means of an operating means located below the game board, and having a magnet and being movable parallel to the game board, at least two operating means being mutually separated by an intermediate layer located below and parallel to the game board.

In games where pieces provided with magnets and located on a game board are operated via operating means located below the game board and provided with a magnet it is often a problem that the operating means collide with each other below the game board. This reduces the movability of the pieces and also reduces the number of pieces that could be used. In order to eliminate such problems it has been suggested, according to SE 7309280-1, a game of the kind initially defined, where below the game board there are provided vertically separate spaces for operating means, separated by intermediate layers. Each intermediate layer is stiff and is located at a distance below the game board or the closest intermediate layer essentially equal to the thickness of the respective operating means, so as to make the operating means easily movable. In this way movability is improved at least for pieces having their operating means close to the game board. Movability, however, becomes quickly reduced as the distance to the game board increases, the result being that in practice the number of pieces that could be used becomes small.

The purpose of the invention is to provide a better game, where a greater number of pieces could be used, while providing good movability for the pieces. Said purpose of the invention is achieved by having several intermediate layers, each of which is thin and easily flexible, resting on top of each other, with the game board resting on the top intermediate layer and the bottom intermediate layer resting on a base, the intermediate layers being locally held apart from each other and from the game board and from the base by means of individual operating means, of which these are provided at least one on each side of each intermediate layer.

This solution allows short distances between the game board and the operating means even when the number of pieces is large, the result being good movability.

A piece provided with a magnet and intended to be used in a game of the kind where each piece is movable on a game board by means of an operating means located below the game board and having a magnet, is in accordance with the invention provided with two supports, e.g. the feet of a human figure, intended for contact with the game board, said magnet constituting a supporting surface on one of the supports and the supporting surface on the other support being of a friction material.

This embodiment of a piece makes it possible to rotate the piece, as an example for shooting a ball, a puck or the like.

Figure 1:
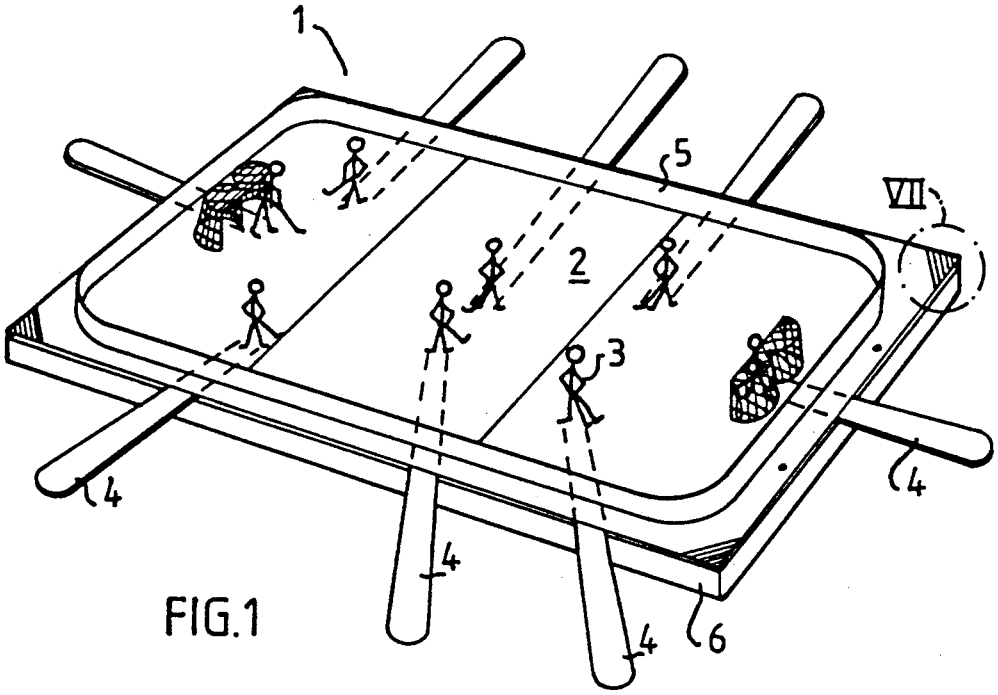
Figure 2:
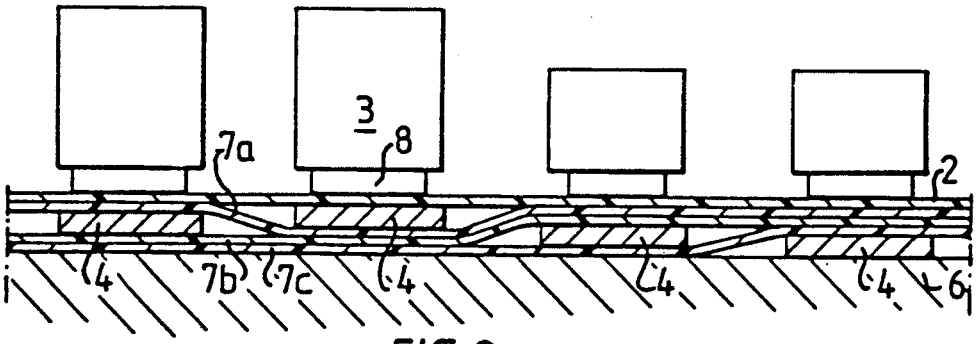
Figure 3:
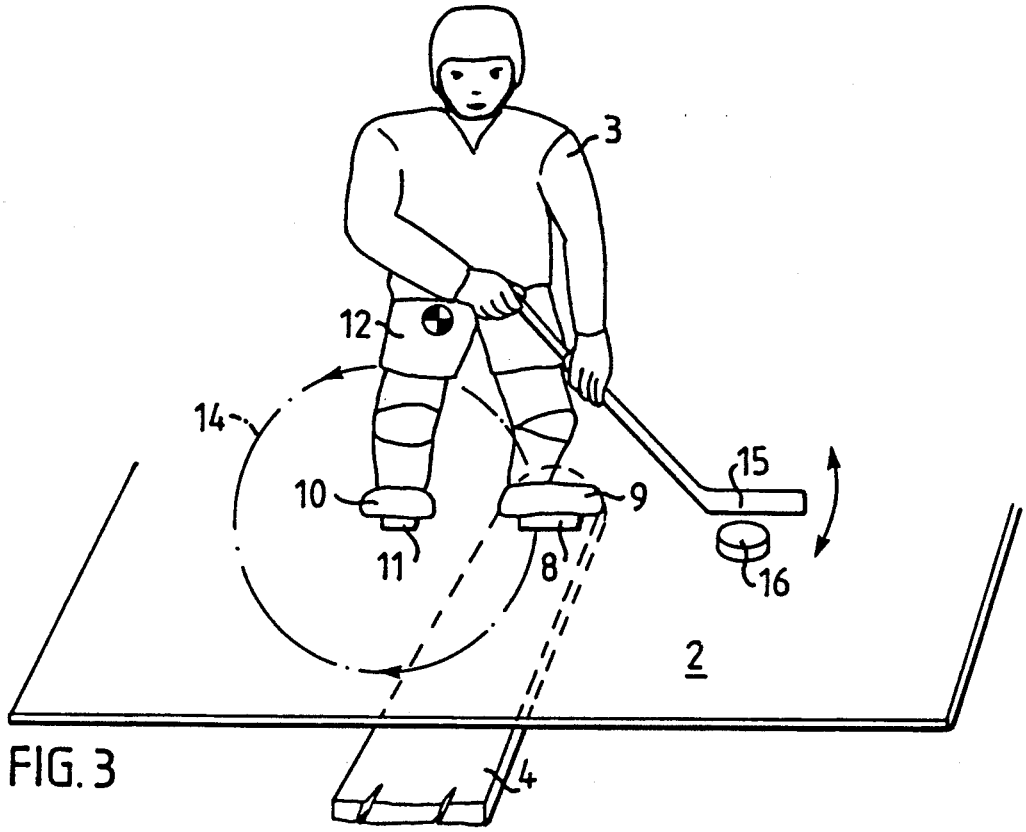
Figure 4:
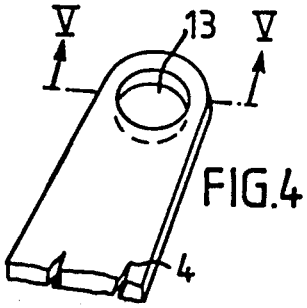
Figure 5:
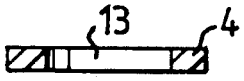
Figure 6:
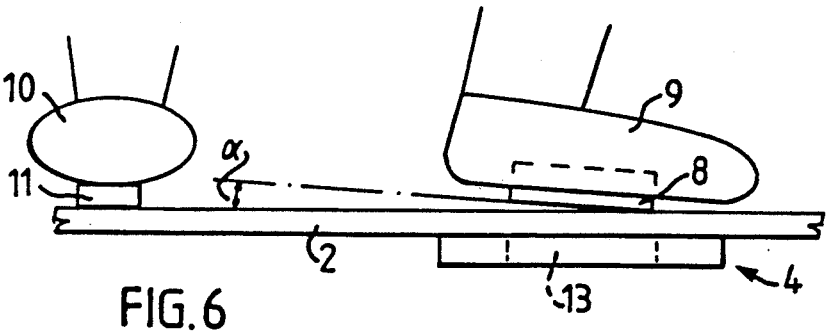
Figure 7:
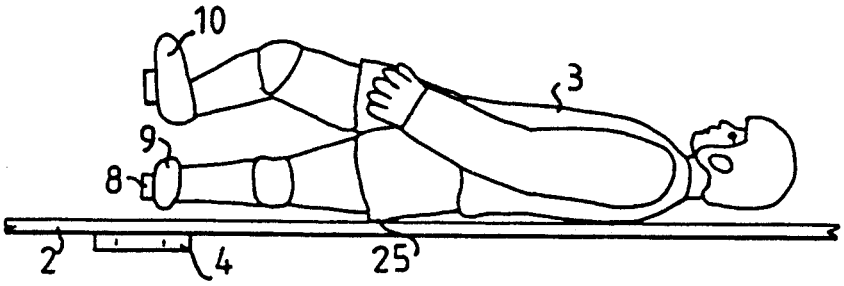
Figure 8:
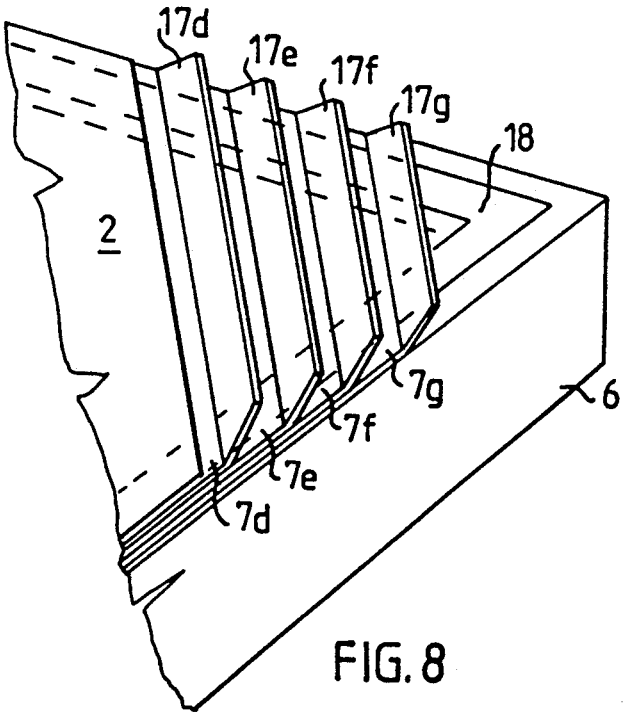
Figure 9:
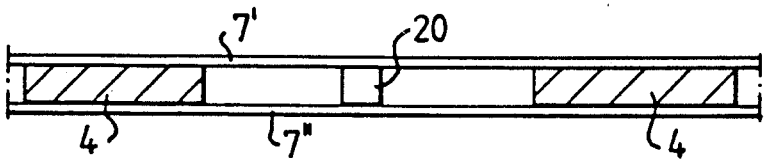
Figure 10:
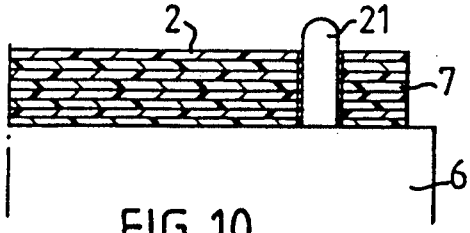
Figure 11:
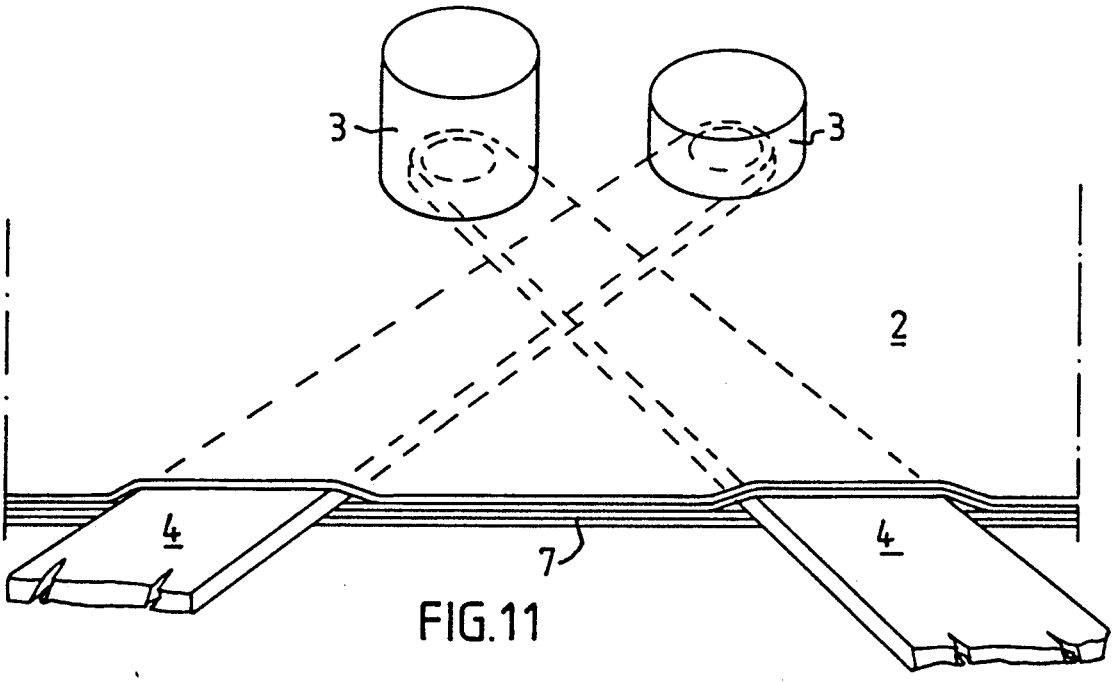

The invention will now be disclosed in more detail by way of reference to preferred embodiments shown on the accompanying drawing, where FIG. 1 is a perspective view of an inventive game, FIG. 2 is a section through an inventive game, FIG. 3 shows how a piece can move, FIG. 4 shows one end of an operating means, FIG. 5 is a section V—V of FIG. 4, FIG. 6 is a detail of the piece shown in FIG. 3, FIG. 7 shows the raising of a fallen piece, FIG. 8 is an enlargement of the detail VIII in FIG. 1, FIG. 9 shows an obstacle between two intermediate layers, and FIG. 10 shows how the game board and the intermediate layers are secured to the base, and FIG. 11 shows how two operating means can cross each other.

In a game 1 according to the invention there is included a game board 2 on which a number of pieces 3 are each magnetically operable by means of an operating means 4 located below the game board. Each operating means is displaceable in any direction parallel to the game board and is at its end located below the game board provided with a magnet intended for cooperation with a corresponding magnet on the respective piece. On top of the game board and around it there runs a stiffener 5 for stiffening the edges of the game board 2 in order to make it easier to hold down the operating means 4. In the embodiment shown the game 1 is an ice-hockey game, where the stiffener 5 is shaped as a board, and where the pieces 3 constitute two teams, each comprising four pieces, one of which is a goal keeper. In order to facilitate movement of the pieces in a team the goal keeper could be operable from one short side of the game board, while the remaining pieces could be operable from one long side of the game board. Below the game board 2 there is a base 6, that could be placed on a table and that is high enough to allow a comfortable gripping of the operating means 4.

An embodiment of the game 1 is shown in more detail in FIG. 2. Between a game board 2 and a base 6 there are inserted a number of operating means 4, which are mutually separated by several intermediate layers *7a, 7b* and *7c*, that rest on top of each other. The game board 2 rests on top of the top intermediate layer *7a*, while the bottom intermediate layer *7c* rests on top of the base 6. The intermediate layers *7a, 7b* and *7c* are thin and easily flexible and are locally held apart at the places where operating means 4 are inserted. When displacing the operating means 4 the intermediate layers are forced apart, and by means of the intermediate layers it becomes possible to slide the operating means 4 across each other for moving the pieces 3 to desired positions.

Since the intermediate layers *7a, 7b* and *7c* are thin and easily flexible they will below each piece become pressed towards each other and towards the lower side of the game board by the magnetic forces, thus eliminating air gaps. In this way good magnetic contact is provided even when there are many intermediate layers. This means that a large number of pieces can be used even when the strength of the magnets is limited.

The game board 2 as well as the intermediate layers and the operating means are of non-magnetic material, such as plastics. The game board 2 is preferably as thick and stiff as the intermediate layers 7, but could also be thicker and stiffer. A suitable thickness of the game board is ca 0.1–1.0 mm, while a suitable thickness of the intermediate layers is 0.1–0.2 mm, depending on the size of game board. The operating means could have a thickness of 1–2.5 mm, suitably 1.5 mm. In order to improve mobility the friction between mutually movable parts should be small, and, further, cooperating magnets should not be too strong.

The shape of the pieces 3 could of course vary, depending on the need and the kind of game. As an example it is possible, as shown in FIG. 2, to have each piece 3 be in contact with the game board 2 only via the magnet 8 of the piece. At games using two teams it is also suitable that the two teams have reverse polarity on their magnets.

FIG. 3 shows an especially advantageous embodiment of a piece 3, allowing the piece to become both displaced and rotated by displacing the operating means 4 in a suitable manner. The piece, as an example a human figure in the shape of an ice-hockey player, football player or the like, is here provided with two supports 9 and 10 intended for contact with the game board 2, said supports being the feet of the figure. The magnet 8 of the piece is located below or in the support 9 and cooperates with an operating means 4 located below the game board 2. Between the operating means 4 and the game board there could be provided a certain number of intermediate layers. The support 9 extends sideways beyond the magnet 8 in order to prevent that the magnet 8 comes too close to a corresponding magnet on another piece. The support 10 rests on the game board 2 via a supporting surface 11 made of a friction material, e.g. a piece of soft rubber. Magnetic force keeps the piece 3 erect, and the center of gravity 12 of the piece is preferably closer to the second support 10 than to the first support 9. By moving the operating means 4 so that its magnet 13 (FIGS. 4 and 5) moves along an arcuate path 14 the piece 3 can be made to turn around a vertical axis through the supporting surface 11, so that the piece, using its stick 15 can deliver a shot with a puck 16. If, instead, the piece 3 is a football player, it can upon turning around its support 10 kick a ball (not shown) with the foot that carries the magnet. A number of further embodiments are of course possible.

As shown in FIGS. 4 and 5 the magnet 13 can be located within an opening at one end of the operating means 4 and be of essentially the same thickness as the rest of the operating means 4. The magnet could suitably have a diameter of ca 10 mm and a thickness of ca 1.5 mm.

In order to increase the force exerted by the second support 10 of the piece against the game board 2 an embodiment of the kind shown in FIG. 6 could be used. The magnet 8 at the support 9 is inclined an angle $\alpha$ in a way such that the magnets tend to turn the piece in a direction where the second support 10 and its supporting surface 11 are forced towards the game board 2, thus increasing the friction between the supporting surface 11 and the game board 2. The angle $\alpha$ could be of the order 2–10°.

Since the various operating means could be moved mutually in any direction it is possible to bring different pieces into contact with each other and to tackle so that opposing pieces fall. It has turned out to be possible, by adequate shaping of the pieces, to easily erect the pieces again by moving the respective operating means into a position where its magnet is located below the magnet of the fallen piece. By interaction of the magnets the piece can then be erected. It is then desirable that the piece is of such a shape and has such a location of its center of gravity that it can be easily erected from a lying position. Also the shape of the support 9 where the magnet 8 is located is of importance. As shown in FIG. 7 the piece 3 is preferably of a shape that locates the magnet 8 at a slight distance above the game board 2 when the piece is fully down. In this way the piece can, using the operating means, be made to pivot around a contact point 25 between the piece and the game board, so that the piece starts to become erected and more easily can reach an upright position.

When the game 1 is not to be used the operating means 4 are preferably removed from their various locations below the game board 2. To facilitate proper reinsertion of the operating means an arrangement of the kind hinted at in FIG. 1 and shown in detail in FIG. 8 could be used. The game board 2 ends a certain distance from each of the corners of the base 6, and a number of intermediate layers *7d, 7e, 7f* and *7g* extend various distances beyond the game board 2 and are at their obliquely cut-off corners provided with flaps 17*d*, 17*e*, 17*f* and 17*g* slightly turned upwards for facilitating insertion of operating means between desired intermediate layers. The flaps can be marked in a suitable way, such as by numbers, to facilitate identification of the various intermediate layers. To advantage insertion locations of the opposing team are at other places, as an example at a different corner.

In order to prevent that while playing operating means are unintentionally extracted it is desirable to provide around the game board means for preventing such extraction. One example of such a means is shown in FIG. 8 where there is inserted at the edge of the base 6 a magnetic strip 18 that is intended to cooperate with the magnets of the operating means.

The ease with which the pieces can be moved is, among other things, a function of the strength of the magnets used. Very strong magnets cause large friction and hence make movement difficult, while on the other hand too weak magnets cause a risk that a piece could not follow its operating means when moved. Thus, the strength of the magnets should be selected such that a safe yet easy movement is obtained. Also, it is possible to use magnets of different strength for different pieces or for different teams. The game board 2 and the intermediate layers can suitably be slightly transparent so as to make it possible to localize the operating means, and the game board could also be provided with adequate markings for the kind of game to be represented.

For certain kinds of games it might be desirable to have on top of a particular intermediate layer two or more operating means, each of which need only be moved below a limited portion of the game board. Possibly the freedom of movement could be restricted by means of obstacles located between the intermediate layers or between the game board or base and the adjacent intermediate layer. One example of locating such an obstacle 20 between two intermediate layers is shown in FIG. 9.

For positioning the game board 2 and the intermediate layers 7 on the base 6, the base 6 can, as hinted at in FIG. 1 and as shown in more detail in FIG. 10, be provided with a number of positioning means 21, for example two at each short side of the game. Said positioning means 21 can, as shown in FIG. 10, comprise pins secured in the base 6 and engaging corresponding holes in the game board 2 and in the intermediate layers 7. In this way freedom to move in a vertical direction is provided for the game board and for the intermediate layers.

As clearly shown in FIG. 11 the operating means of two different pieces 3 can be moved over each other and cross each other, while retaining control of the respective pieces. This allows excellent movability in any direction over the entire game board.

We claim:

1. A piece provided with a magnet and intended to be used in a game wherein said piece (3) is movable on a game board (2) by means of an operating means (4) located below the game board and having a magnet (8), said piece having two spaced apart supports (9, 10) downwardly exposed for direct contact with the game board, said magnet (8) constituting a lowermost downwardly exposed supporting surface on one of the supports (9), and the supporting surface (11) on the other support (10) being a lowermost downwardly exposed surface of a high friction material, whereby said high friction material serves as a pivot, around which said piece (3) swings, to enable said supporting surface (11) on the other support (10) to turn in place while said magnet (8) is enabled to describe a circle as said operating means (4) are moved in a circular path.

2. A piece according to claim 1, wherein the center of gravity (12) of the piece is located closer to the other support (10) than to the first support.

3. A piece according to claim 1, wherein the magnet is mounted at an angle ($\alpha$) relative tot he plane of the board so that the other support (10) is forced towards the game board (2) when the magnet is influenced by the corresponding operating means (4).

4. A piece according to claim 1, wherein each piece at its magnet (8) extends sideways beyond and around the magnet for limiting the attractive force between pieces.

5. A piece according to claim 1, wherein the shape of the piece and the location of the center of gravity of the piece are selected so as to facilitate reerection of a fallen piece by using the operating means.

* * * * *